US008985584B2

(12) United States Patent
Jimick

(10) Patent No.: US 8,985,584 B2
(45) Date of Patent: Mar. 24, 2015

(54) GAME APPARATUS AND METHOD OF PLAY

(76) Inventor: David M. Jimick, Chalfont, PA (US)

( * ) Notice: Subject to any disclaimer, the term of this patent is extended or adjusted under 35 U.S.C. 154(b) by 982 days.

(21) Appl. No.: 12/506,666

(22) Filed: Jul. 21, 2009

(65) Prior Publication Data

US 2011/0018202 A1 Jan. 27, 2011

(51) Int. Cl.

| | |
|---|---|
| ***A63F 3/00*** | (2006.01) |
| ***A63F 3/02*** | (2006.01) |
| *A63F 9/24* | (2006.01) |

(52) U.S. Cl.

CPC ..... *A63F 3/00643* (2013.01); *A63F 3/02* (2013.01); *A63F 9/24* (2013.01); *A63F 2003/00287* (2013.01); *A63F 2003/00583* (2013.01); *A63F 2003/00716* (2013.01)

USPC ..... 273/271; 273/258; 273/260; 273/262

(58) Field of Classification Search

CPC ..... A63F 3/02; A63F 3/00643; A63F 2003/00716; A63F 2003/00287; A63F 2003/00583; A63F 9/24

USPC ..... 273/258, 260, 262

See application file for complete search history.

(56) References Cited

U.S. PATENT DOCUMENTS

| | | | | |
|---|---|---|---|---|
| 677,782 | A * | 7/1901 | Lanz | 273/258 |
| 2,316,862 | A * | 4/1943 | Haggard et al. | 273/258 |
| 4,801,147 | A * | 1/1989 | Miller | 273/276 |
| 5,340,114 | A * | 8/1994 | Wester | 273/260 |
| 5,607,156 | A | 3/1997 | Samarasinghe | |
| 5,657,990 | A * | 8/1997 | Patel | 273/263 |
| 6,142,869 | A | 11/2000 | Meyer et al. | |
| 7,287,754 | B2 * | 10/2007 | Conner | 273/260 |
| 2004/0065999 | A1 * | 4/2004 | Syed et al. | 273/260 |
| 2004/0086835 | A1 | 5/2004 | Otto | |

* cited by examiner

*Primary Examiner* — Vishu Mendiratta
(74) *Attorney, Agent, or Firm* — Howson & Howson LLP

(57) ABSTRACT

In a board- or computer-implemented game, each of two opposing players is associated with a set of markers distinguishable from the markers associated with the other player. The markers are initially set up in an array of mutually perpendicular rows and columns of allowable marker positions, with the markers of each player being in two adjacent rows and a V-shaped pattern composed of two oblique rows extending from an apex toward end markers in a second of the two rows. Players take turns, moving markers to unoccupied allowable positions, optionally jumping their own markers, and optional jumping and capturing an opponent's marker or markers.

12 Claims, 4 Drawing Sheets

GAME APPARATUS AND METHOD OF PLAY

FIELD OF THE INVENTION

This invention relates to games, and more specifically to a game designed for competition between two opposing players, who take turns moving markers on a playing field, each being able to remove the other's markers by jumping over the same.

BACKGROUND OF THE INVENTION

In a number of popular board games, markers are moved about on a board marked with spaces corresponding to allowable marker positions. The most well known of these games is "checkers," in which each of two players has a set of pieces initially arranged in a predetermined starting pattern on a board having 64 squares in an 8×8 pattern. The players take turns moving markers diagonally, jumping and "taking" each other's pieces. There are numerous variations, including "Chinese checkers," in which the allowable marker positions are arranged in a "Star of David" pattern.

Another board game, which is in the nature of a puzzle, designed for a single player, is the familiar "golf tee puzzle," in which fourteen golf tees are placed in fourteen of fifteen holes in a triangular array on a board. The player can jump and remove any piece if there is an empty hole on the opposite side, and tries to remove as many tees as possible.

While the games were originally designed as board games, and are still played that way, they are also played by computer. Two opposing checkers players, for example, can play against each other while at different locations through an electronic communications network, e.g., the Internet, using personal computers programmed with suitable game software. Alternatively, a single player can play against a computer, which can be the player's own computer, or a suitably programmed server at a remote location. In a similar manner, a single player can play the golf tee puzzle using software on his or her own computer, or by remote access to a suitably programmed server.

SUMMARY OF THE INVENTION

The game according to this invention bears similarities to the checkers games and also to the golf tee puzzle. However, the initial set-up, i.e., the arrangement of markers at the beginning of the game, and the move options, are different from those of conventional games, and present a uniquely challenging strategy planning task to each player.

In accordance with one aspect of the invention, in which the game can be described as a method, a playing field is marked with a two-dimensional array of spaces representing allowable positions for markers. These allowable positions are arranged in mutually perpendicular rows and columns. The field has at least eight rows and at least five columns, with first and second opposite ends to which the columns are perpendicular.

First and second groups of movable markers are set up on the playing field in a starting arrangement, the first group being associated with a first player and the second group being associated with a second, opposing, player. The markers of the first group are distinguishable from the markers of the second group, and disposed in a pattern as follows. A number of markers is disposed in successive allowable positions in a first row closer to one of the opposite ends of the playing field than to the other. An identical number of markers is disposed in successive allowable positions in a second row adjacent the first row but closer than the first row to the other end of the playing field. Each marker in the first row is in the same column as an adjacent marker in the second row. Additional markers are disposed in at least one V-shaped pattern, each V-shaped pattern consisting of two oblique rows extending to the second row from an apex position spaced from the second row by at least one unoccupied space. The second group is disposed in a pattern that is a mirror image of the pattern of the first group, and each apex position marker of the second group is in the same column as an apex position marker of the first group.

The players, taking alternating turns, move their own markers only in row-wise or column-wise directions. In each turn, a player either passes, giving up the turn, or selects a marker, and moves the same in one of three categories of moves. The categories consist of: (a) moving the marker to an adjacent unoccupied allowable space, ending the turn; (b) jumping over an adjacent marker into an unoccupied allowable space on the opposite side of said adjacent marker, ending the turn; and (c) jumping over an adjacent marker into an unoccupied allowable space on the opposite side of an adjacent marker, and continuing to jump one or more adjacent markers into unoccupied spaces on the opposite sides thereof.

Each player removes jumped markers from the field if the jumped markers are associated with the other player. At a mutually agreed upon time, or under mutually agreed-upon conditions, the player who has jumped and removed the larger number of the opponent's markers is considered a winner.

Preferably, in the starting arrangement, each apex position marker of the second group is separated from an opposite apex position marker of the first group in the same column by at least two rows of allowable positions In a comparatively simple preferred version of the game, the field has twelve rows and seven columns, the number of markers in each of the first and second rows is seven, the number of V-shaped patterns in the first group is one, and the number of markers in the V-shaped pattern is five.

In a more complex preferred version, the field has twelve rows and fourteen columns, the number of markers in each of the first and second rows is fourteen, the number of V-shaped patterns in the first group is two, and the number of markers in each V-shaped pattern is five.

In a still more complex preferred version of the game, the field has twelve rows and twenty one columns, the number of markers in each of the first and second rows is twenty one, the number of V-shaped patterns in the first group is three, and the number of markers in each V-shaped pattern is five.

In accordance with another aspect of the invention, in which the game can be described as a game apparatus, the apparatus comprises a playing and markers configured and arranged as described above.

Objects and advantages of the invention will be apparent from the following description when read in conjunction with the drawings.

DETAILED DESCRIPTION OF THE PREFERRED EMBODIMENTS

Figure 1:
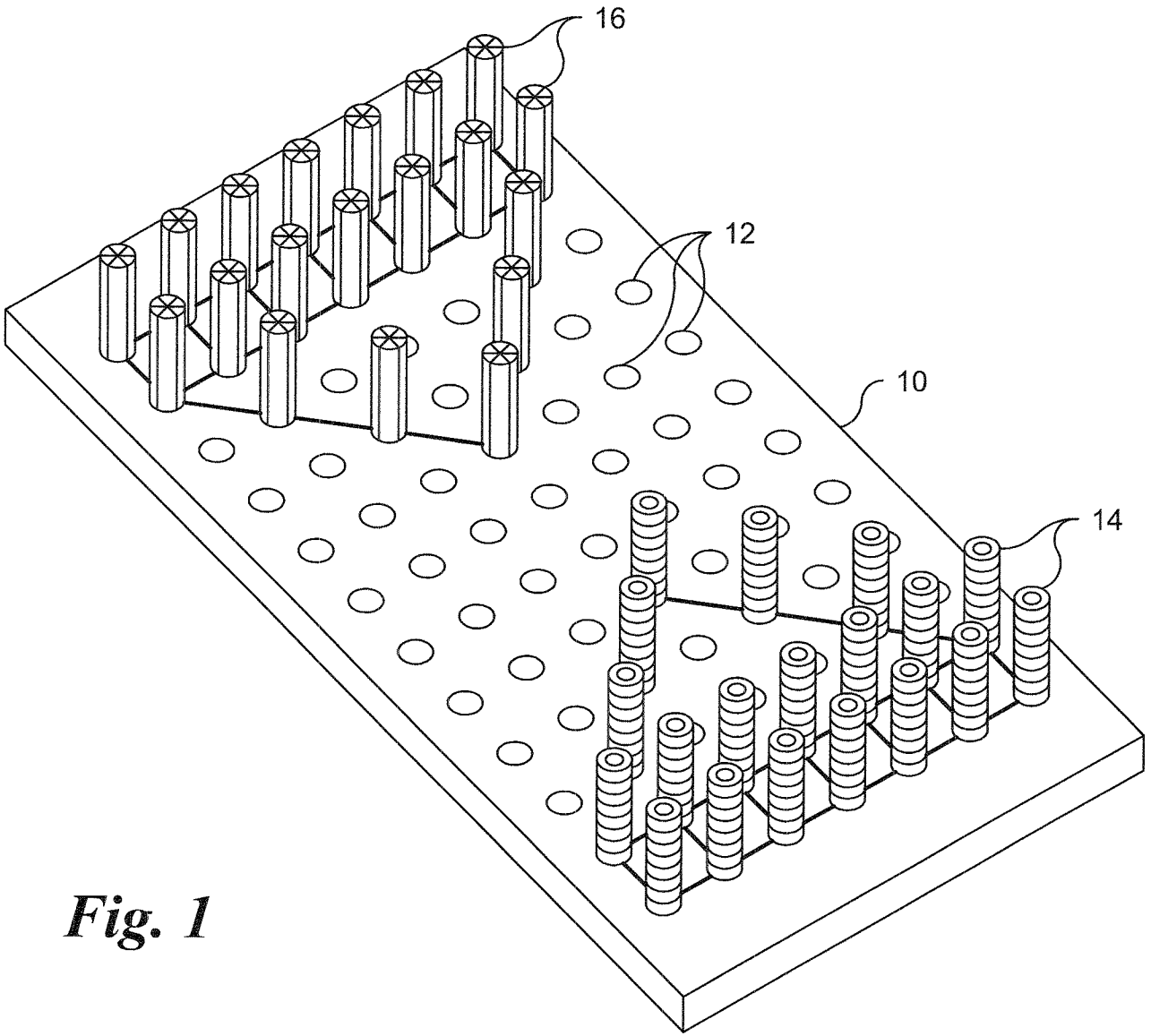
FIG. 1 is an oblique perspective view of a game board with movable markers in their initial arrangement in accordance with a first embodiment of the invention.

As shown in FIG. 1, a relatively simple version of the game is played using a game board 10 having an array of holes 12 arranged in seven columns and twelve rows, the rows extending in directions perpendicular to the columns. Each of two opposing players is assigned a set of markers, which can be, but are not necessarily, in the form of cylindrical pegs. The markers preferably fit snugly into holes 12, but are readily removable so that they can be moved to other holes in the 7×12 array. The markers associated with each player are distinguishable, e.g., by color, from the pegs assigned to the other player. For example, markers 14 can be blue pegs, whereas markers 16 can be red pegs.

Figure 2:
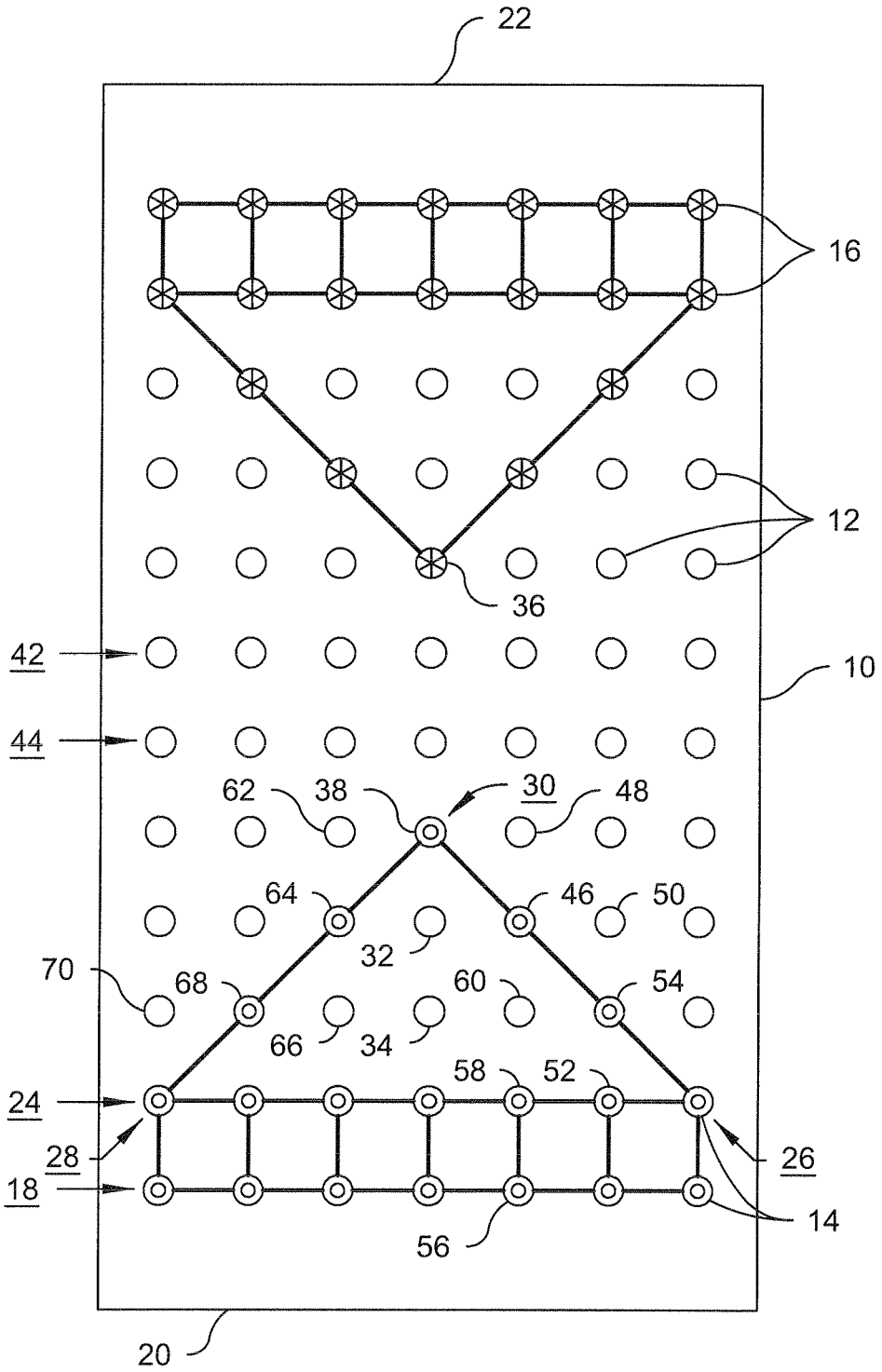
FIG. 2 is a top plan view of the game board of FIG. 1.

Before play begins, the pegs are set up in an initial arrangement, an example of which is illustrated in FIGS. 1 and 2, and better understood from FIG. 2. The holes 12 in the board represent allowable positions for the markers. In the initial arrangement, markers 14 occupy all the holes in a first row 18 closer to end 20 of the board than to the opposite end 22, and an adjacent second row 24, which is closer than row 18 to the opposite end 22 of the board. As seen in FIG. 2. Each marker in the row 18 is in the same column as an adjacent marker in row 24. Additional markers are disposed in a V-shaped pattern consisting of two oblique rows 26 and 28, extending from an apex position 30, spaced from the second row 24 by two unoccupied spaces 32 and 34, to the second row.

The second group of markers 16 is disposed in a pattern that is a mirror image of the pattern of the first group 14, and the apex position marker 36 of the second group 16 is in the same column as the apex position marker 38 of the first group. The apex position markers 36 and 38 are separated from each other by two rows, 40 and 42, of allowable positions.

After choosing which player has the first move, the players take alternating turns, moving their own markers only in row-wise or column-wise directions. In each turn, a player can pass, thereby giving up his or her turn, or selects a marker, and moves the same in one of three categories of moves. The categories consist of: (a) moving the selected marker to an adjacent unoccupied allowable space, ending the turn, (b) jumping the selected marker over an adjacent marker into an unoccupied allowable space on the opposite side of the jumped marker, ending the turn, and (c) jumping the selected marker over an adjacent marker into an unoccupied allowable space on the opposite side of the jumped marker, and continuing to jump one or more adjacent markers into unoccupied spaces on the opposite sides thereof, where possible. Each player removes jumped markers from the field if the jumped markers are associated with the other player. Although each player has various move options, the game cannot progress unless at various stages of the game, a player jumps into an unoccupied allowable space on the opposite side of an adjacent marker associated with an opposing player, and removes that adjacent marker.

At a mutually agreed upon time, or under mutually agreed-upon conditions, the player who has jumped and removed the larger number of the opponent's markers is considered a winner. An example of a mutually agreed-upon condition is a situation in which one player has no more markers, or has no available set of moves that could result in that player's having more remaining markers than the opponent.

An example of a move in category (a) is a move of marker 46 to space 48, space 50 or space 52. An example of a move in category (b) is a move of marker 52 to space 50 by jumping over marker 54. An example of a move in category (c) is a move in which marker 56 is jumped over marker 58 into space 60, then jumped over marker 46 into space 48, and finally, jumped over marker 38 into space 62. The move could continue by jumping marker 56 over marker 64 into space 66, and then over marker 68 into space 70. At that point, the turn ends because there are no more available moves for marker 56. When the turn ends, either by the player's voluntarily refraining from moving, or from moving further after one or more allowable moves, or is unable to make a move, the player associated with markers 16 makes the next move.

The field of allowable marker positions can have a number of variations. It can consist of as few as eight rows and five columns. In that case, the apex markers associated with the opposing players will be immediately adjacent to each other, and each apex marker will be spaced from the second row of markers by only a single unoccupied allowable marker position. The preferred game board, however, is as shown in FIG. 2, wherein the apex markers are spaced from each other by two unoccupied allowable marker positions and also spaced from the second row in their marker group by two unoccupied allowable marker positions. In that case, the field has at least seven columns and at least twelve rows.

Figure 3:
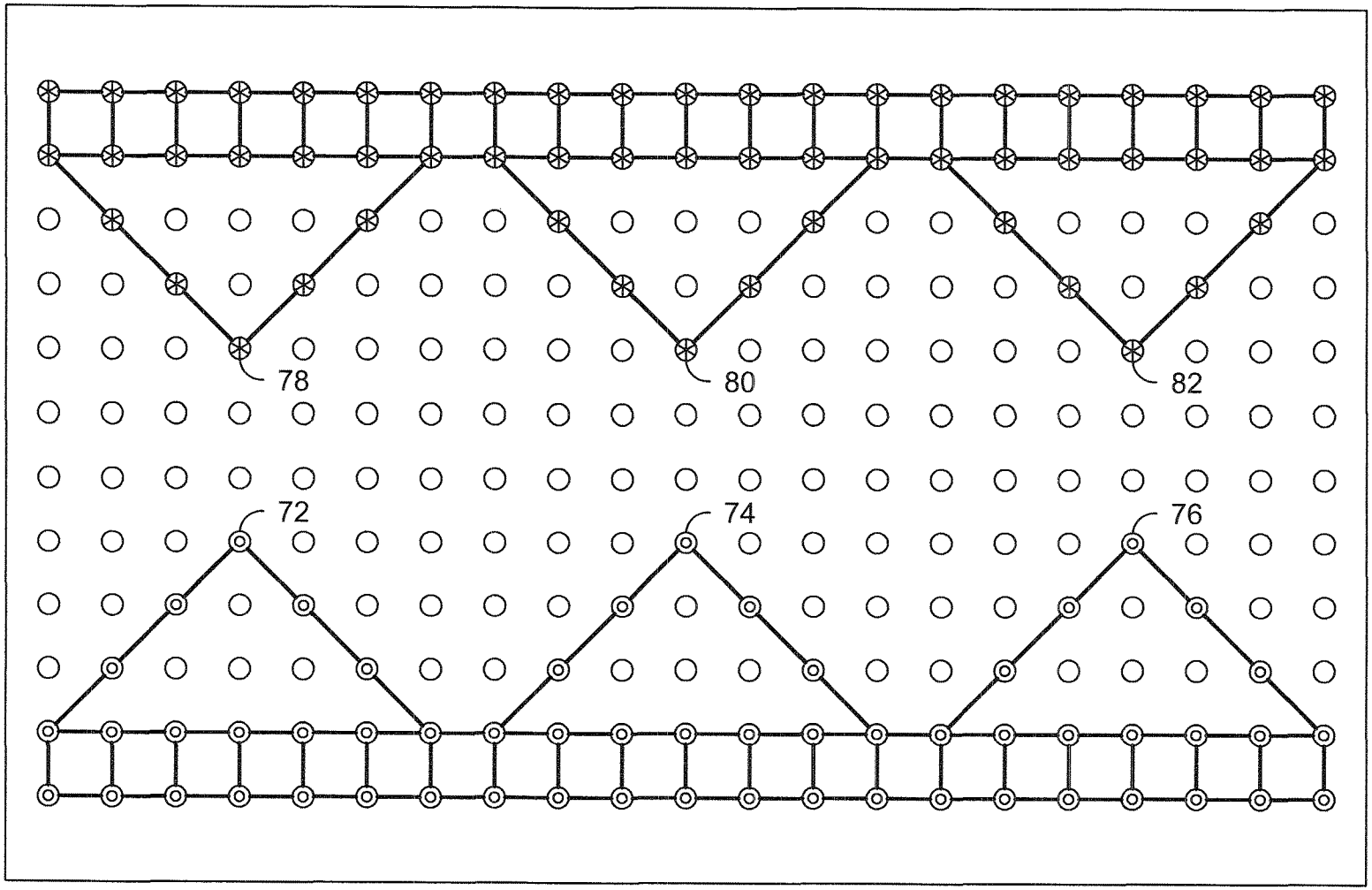
FIG. 3 is a top plan view of a game board with movable markers in their initial arrangement in accordance with a second embodiment of the invention.

In the alternative version of the game board depicted in FIG. 3, the layout corresponds essentially to three of the game boards of FIG. 2 in side-by-side relationship. The array of allowable marker positions consists of twelve rows and twenty one columns. Each of the three apex markers, e.g., markers 72, 74 and 76, associated with one player are initially positioned in the same column as an apex marker 78, 80 or 82, associated with the opponent. Here, as in the first embodiment, each of the apex markers of one player is separated by two allowable marker positions from an apex markers of the opponent. Each apex marker is also separated from the second row in its group of markers by two allowable marker positions. Play with the embodiment of FIG. 3 is similar to play with the embodiment of FIGS. 1 and 2, except that a marker has a greater lateral (row-wise) range of movement. That is, markers are not limited to movement in a given group of seven columns. It is possible, for example, for a marker originally in the first column to travel as far as the twenty-first column.

The arrangement of FIG. 3 is also subject to a wide range of variations, including reduction of the number of rows so that opposing apex markers are adjacent one another, or spaced by only one row rather than by two rows. The number of markers in each V-shaped array can be reduced from five to three, in which case the apex markers are spaced from the second rows in their groups by only one allowable marker position, and the number of columns is reduced from twenty one to fifteen.

Another alternative to the arrangement of FIG. 3 is one in which adjacent oblique rows of adjacent V-shaped arrays markers extend toward the apices from a common position in a second row, in which case the number of columns will be reduced from twenty one to nineteen and the number of rows can be as few as eight. The above-describe fifteen column version can be similarly modified so that the number of columns is reduced to thirteen.

In still another variation (not shown), the game board can be arranged to correspond to two of the game boards of FIG. 2 in side-by-side arrangement so that the number of columns is fourteen. The arrangement is then essentially two thirds of the game board arrangement in FIG. 3. Here again, modifications can be made similar to those described above with reference to FIG. 3 so that the number of rows can be reduced to as few as eight, and the number of columns can be thirteen, ten or nine.

A variety of other arrangements within the scope of the appended claims can be adopted. The markers, of course can take any of various forms such as discs, balls, golf tees, etc., and the allowable marker positions can be defined by printed spaces, depressions or the like.

Figure 4:
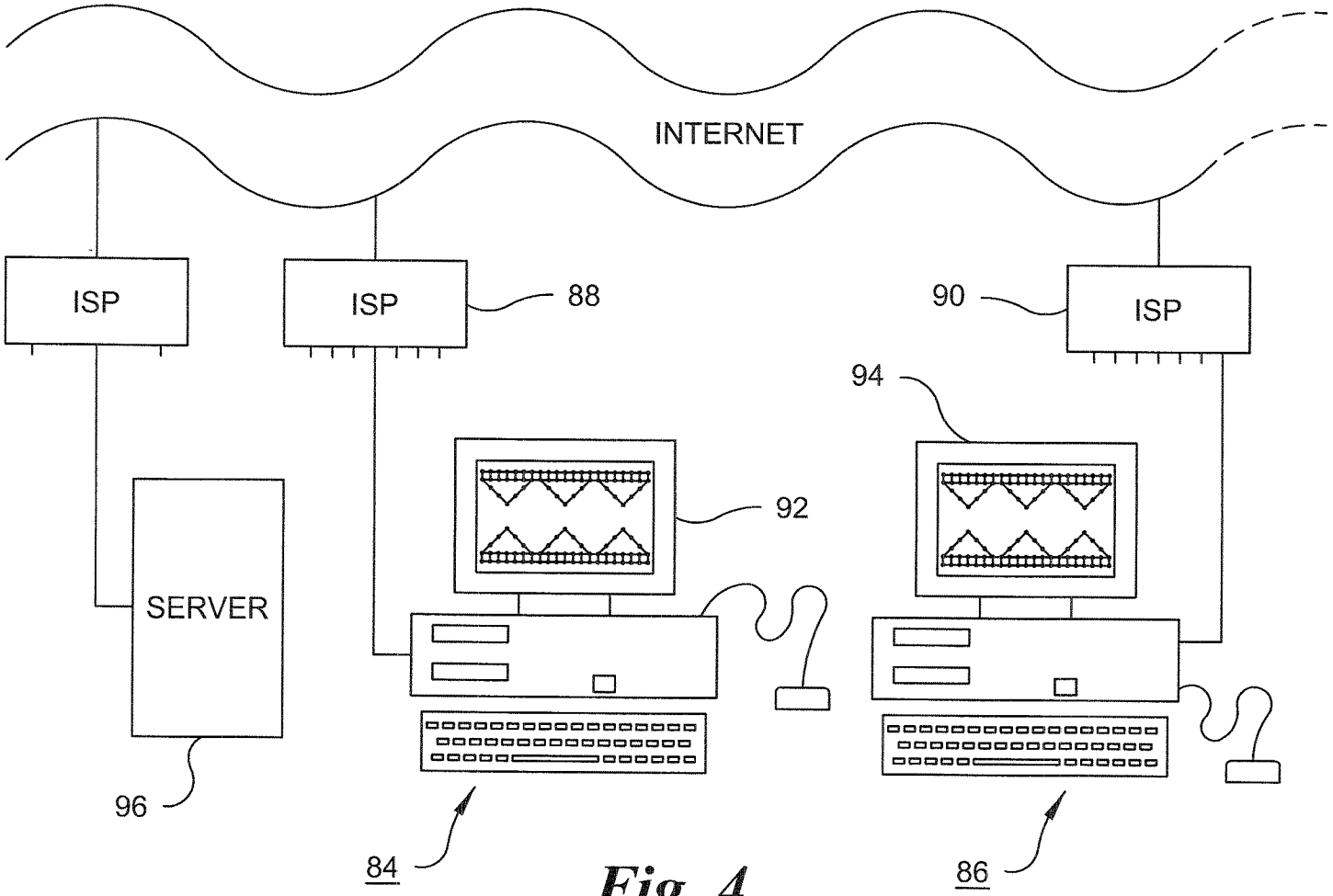
FIG. 4 is a schematic diagram of a third embodiment of the invention in which the game is played electronically using one or more personal computers.

Although the game can be conveniently embodied as a board game, it can also be played using a personal computer or plural personal computers interconnected to one another. For example, FIG. 4 shows two personal computers 84 and 86 used as terminals connected to each other through the Internet by internet service providers (ISPs) 88 and 90. The computers have display screens 92 and 94, on which displays are generated electronically by locally loaded software, showing a game array similar to that of FIG. 3. Players at remote locations can see the same screen, or preferably, each player sees an upside-down version of the other's screen. Moves can be implemented by using a mouse to move a cursor to a displayed marker, clicking the mouse to select and lock the cursor onto the marker, and moving the marker to one or more allowable positions. Jumped makers of an opposing player can be removed automatically by the game software, which can also display the number of remaining markers associated with each player. Software capable of simulating the board version of the game is well within the level of ordinary skill of game software designers.

The computer version of the game can also be implemented by player-simulating software which enables a single player to compete against a computer. The player-simulating software can be loaded locally into a personal computer such as computer 85 or 86, or suitable player-simulating software can be loaded into a server 96 for remote access by one or more individuals using personal computers connected to the Internet. In addition, the software can be incorporated into a hand-held device such as a personal digital assistant (PDA), a game-capable mobile telephone, or a dedicated hand-held electronic game. Here again, the design of suitable player-simulating software is within the level of ordinary skill in the game software industry.

When the game is implemented by computer, provision can be made for selection by a player or players of a particular version from several versions of the game, such as a simple version corresponding to FIG. 2 and a more complex version corresponding to FIG. 3. In addition, it is possible for software to enable a player to make a selection of the number of rows, the number of columns, or both, from a plurality of choices including, but not necessarily limited to, the choices mentioned above with reference to FIGS. 2 and 3.

The game according to the invention presents a challenge to each player to plan a strategy for removal of a maximum number of the opponent's markers by anticipating possible opposing moves. Variations on the game can be adopted. For example, a set of rules can be adopted in which the players do not have an option to "pass" or in which the players are limited to forward and sideward moves and do not have an option to move backward.

Numerous other variations on the game layout and on the move options can be adopted without departing from the scope of the invention as defined in the following claims.

What is claimed is:

1. A method of playing a game comprising:

establishing, on a physical game board, a playing field marked with a two-dimensional array of spaces representing allowable positions for markers, said allowable positions being arranged in mutually perpendicular rows and columns, the field having at least eight rows and at least five columns, the playing field having first and second opposite ends to which the columns are-perpendicular;

setting up first and second groups of movable markers on said playing field in a starting arrangement, the first group being associated with a first player and the second group being associated with a second, opposing, player, the markers of the first group being distinguishable from the markers of the second group, the markers of the first group being disposed in a pattern consisting of a number of markers in successive allowable positions in a first row closer to one of said opposite ends than to the other, an identical number of markers in successive allowable positions in a second row adjacent said first row, the second row being closer than the first row to said other end of the playing field, each marker in the first row being in the same column as an adjacent marker in the second row, and additional markers disposed in at least one V-shaped pattern, each V-shaped pattern consisting of two oblique rows extending to the second row from an apex position spaced from the second row by at least one unoccupied space, the second group being disposed in a pattern that is a mirror image of the pattern of the first group, each apex position marker of the second group being in the same column as an apex position marker of the first group, and said .rows and V-shaped patterns of the first and second groups of markers comprising substantially all of the markers on the playing field;

wherein the first and second players, taking alternating turns, move their own markers only in row-wise or column-wise directions, in each turn, a player either passes, giving up a turn, or selects a marker, and moves the same in one of three categories of moves, the categories consisting of (a) moving the marker to an adjacent unoccupied allowable space, ending the turn, (b) jumping over an adjacent marker into an unoccupied allowable space on the opposite side of said adjacent marker, ending the turn, and (c) jumping over an adjacent marker into an unoccupied allowable space on the opposite side of said adjacent marker, and continuing to jump one or more adjacent markers into unoccupied spaces on the opposite sides thereof;

wherein each player removes jumped markers from the field if the jumped markers are associated with the other player; and wherein, at a mutually agreed upon time or under mutually agreed-upon conditions, the player who has jumped and removed the larger number of the opponent's markers is considered a winner.

2. A method according to claim 1, in which, in each of plural turns, a player jumps into an unoccupied allowable space on the opposite side of an adjacent marker associated with an opposing player, and removes said adjacent marker associated with said opposing player.

3. A method according to claim 1, in which, in the starting arrangement, each apex position marker of the second group is separated from an opposite apex position marker of the first group in the same column by at least two rows of allowable positions

4. A method according to claim 1, in which the field has twelve rows and seven columns, in which the number of markers in each of said first and second rows is seven, in which the number of V-shaped patterns in the first group is one, and in which the number of markers in said one V-shaped pattern is five.

5. A method according to claim 1, in which the field has twelve rows and fourteen columns, in which the number of markers in each of said first and second rows is fourteen, in which the number of V-shaped patterns in the first group is two, and in which the number of markers in each said V-shaped pattern is five.

6. A method according to claim 1, in which the field has twelve rows and twenty one columns, in which the number of markers in each of said first and second rows is twenty one, in which the number of V-shaped patterns in the first group is three, and in which the number of markers in each said V-shaped pattern is five.

7. A method according to claim 1, in which substantially all of the markers on the playing field are in said rows and V-shaped patterns of the first and second groups of markers.

8. A method according to claim 1, in which all of the markers on the playing field are in said rows and V-shaped patterns of the first and second groups of markers.

9. A game apparatus comprising:

a playing field marked with a two-dimensional array of spaces indicating allowable positions for markers, said allowable positions being arranged in mutually perpendicular rows and columns, the field having at least eight rows and at least five columns, the playing field having first and second opposite ends to which the columns are perpendicular;

first and second groups of movable markers on said playing field, the first group being associated with a first player and the second group being associated with a second, opposing, player, the markers of the first group being distinguishable from the markers of the second group, the markers of the first group being disposed in a pattern consisting of a number of markers in successive allowable positions in a first row closer to one of said opposite ends than to the other, an identical number of markers in successive allowable positions in a second row adjacent said first row, the second row being closer than the first row to said other end of the playing field, each marker in the first row being in the same column as an adjacent marker in the second row, and additional markers disposed in at least one V-shaped pattern, each V-shaped pattern consisting of two oblique rows extending to the second row from an apex position spaced from the second row by at least one unoccupied space, the second group being disposed in a pattern that is a mirror image of the pattern of the first group, and each apex position marker of the second group being in the same column as an apex position marker of the first group and separated from said apex position marker of the first group by at least two rows of allowable positions, said rows and V-shaped patterns of the first and second groups of markers comprising substantially all of the markers on the playing field.

10. A game apparatus according to claim 9, in which each apex position marker of the second group is separated from said apex position marker of the first group by at least two rows of allowable positions.

11. A game apparatus according to claim 9, in which substantially all of the markers on the playing field are in said rows and V-shaped patterns of the first and second groups of markers.

12. A game apparatus according to claim 9, in which all of the markers on the playing field are in said rows and V-shaped patterns of the first and second groups of markers.

* * * * *